US006976737B1

(12) United States Patent
Dandolo

(10) Patent No.: US 6,976,737 B1
(45) Date of Patent: Dec. 20, 2005

(54) FOLDING DECKCHAIR

(75) Inventor: Marani Dandolo, Vicenza (IT)

(73) Assignee: Marga S.r.l., Meledo di Sarego (IT)

( * ) Notice: Subject to any disclaimer, the term of this patent is extended or adjusted under 35 U.S.C. 154(b) by 0 days.

(21) Appl. No.: 10/953,213

(22) Filed: Sep. 29, 2004

(51) Int. Cl.[7] ..... A47C 31/02
(52) U.S. Cl. ..... 297/218.3; 297/218.4; 297/218.5; 297/452.59
(58) Field of Search ..... 297/218.1, 218.3, 297/218.4, 218.5, 452.58, 452.59; 24/370

(56) References Cited

U.S. PATENT DOCUMENTS

| | | | | |
|---|---|---|---|---|
| 794,145 | A * | 7/1905 | Ellington et al | 297/228.11 |
| 2,675,857 | A | 4/1954 | Bloom | |
| 4,058,341 | A * | 11/1977 | Prins | 297/218.5 |
| 6,082,820 | A * | 7/2000 | Jeng | 297/440.11 |

FOREIGN PATENT DOCUMENTS

| | | |
|---|---|---|
| FR | 2 182 590 A | 12/1973 |
| GB | 717 864 A | 11/1954 |
| GB | 1 360 375 A | 7/1974 |
| IT | VI 940 041 U | 2/1996 |

* cited by examiner

*Primary Examiner*—Anthony D Barfield
(74) *Attorney, Agent, or Firm*—Bucknam and Archer

(57) ABSTRACT

A folding deckchair, of the kind with a frame (2) to which fabric (3) is fitted, and wherein the fixing between the side ends of the fabric and the side portions of the frame is attained through an elastic cord inserted through a plurality of eyelets located on the edges of the fabric, as well as fixed using several hooks (6) between every two subsequent eyelets and projecting from the frame. Said chair is characterized by the special methods of mutual fixing between the frame (2) and the fabric (3).

3 Claims, 2 Drawing Sheets

FOLDING DECKCHAIR

The present invention refers to a folding deckchair, of the kind with a metal frame to which fabric, acting as seat and back, is fixed.

Chairs of this kind have been widely known on the market for a long time; one of the problems in terms of construction and functionality normally encountered in these kinds of chairs is the need to fix the fabric to the frame in a safe and firm manner.

In the most common construction regulations, which are used to satisfy this objective, a corrugated steel rod is normally used and is applied to the frame in order to create closed loops through which a cord inserted in the fabric is passed, which keeps the above-mentioned fabric and frame firmly fixed together.

Even though this system is effective, it makes the replacement procedure of the fabric very difficult should the fabric break or if for any reason the user decides to change it, for example, to have a chair of a different color.

In order to overcome this problem, the Italian Patent document no. 00232471 issued on Oct. 1, 2000, to the same applicant, describes a folding deckchair which has a metal frame to which fabric, acting as seat and back, is fixed, where fixing between the side ends of the fabric and the side portions of the frame is carried out by an elastic cord inserted through a plurality of eyelets located on the edges of the fabric, as well as fixed using several hooks which are positioned in such a way as to be positioned between two subsequent eyelets, taken from a strip of the frame.

The drawback with this kind of construction derives from the fact that in order to join the strip fitted with hooks to the frame it is necessary to use rivets, screws or other mechanical connections, which obviously requires time and the use of specific machinery, in the case of automatic production or qualified personnel, in the case of manual production, all of which prejudices cost-performance of production and therefore the final cost of the product which, on the contrary, should not be too high considering the nature of its use.

The objective of this finding is to create a folding deckchair fitted with hooks in which the stable connection of said hooks to the frame does not require the use of additional mechanical elements and which results in an easy and quick execution.

In terms of construction the support of the hooks is made up of a tube, which slides onto the side portion of the frame; its fixing is guaranteed by the friction that comes about on the contact surface between the two elements mutually fitted into each other, following the pulling force generated by the fabric when it is hooked under pressure, through the use of the cords, to the frame itself.

Greater understanding of the finding can be found in the description of a possible embodiment, purely given as a non limiting example, with the help of the drawings attached, in which:

FIG. 1. (Table I) illustrates a folding deckchair fitted with a hooking device of the fabric to the frame as to the finding;

Figure 1:
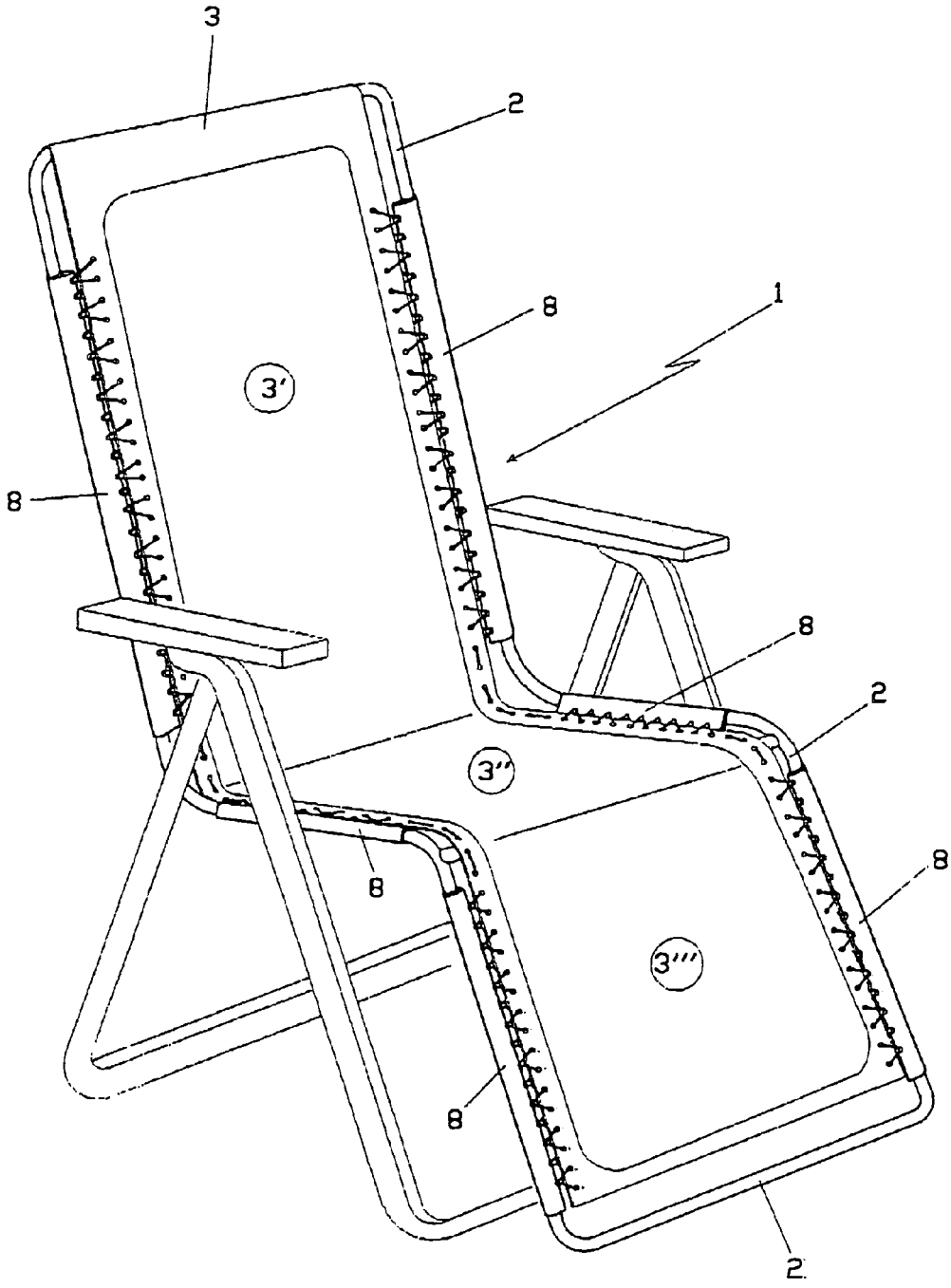
Figure 2:
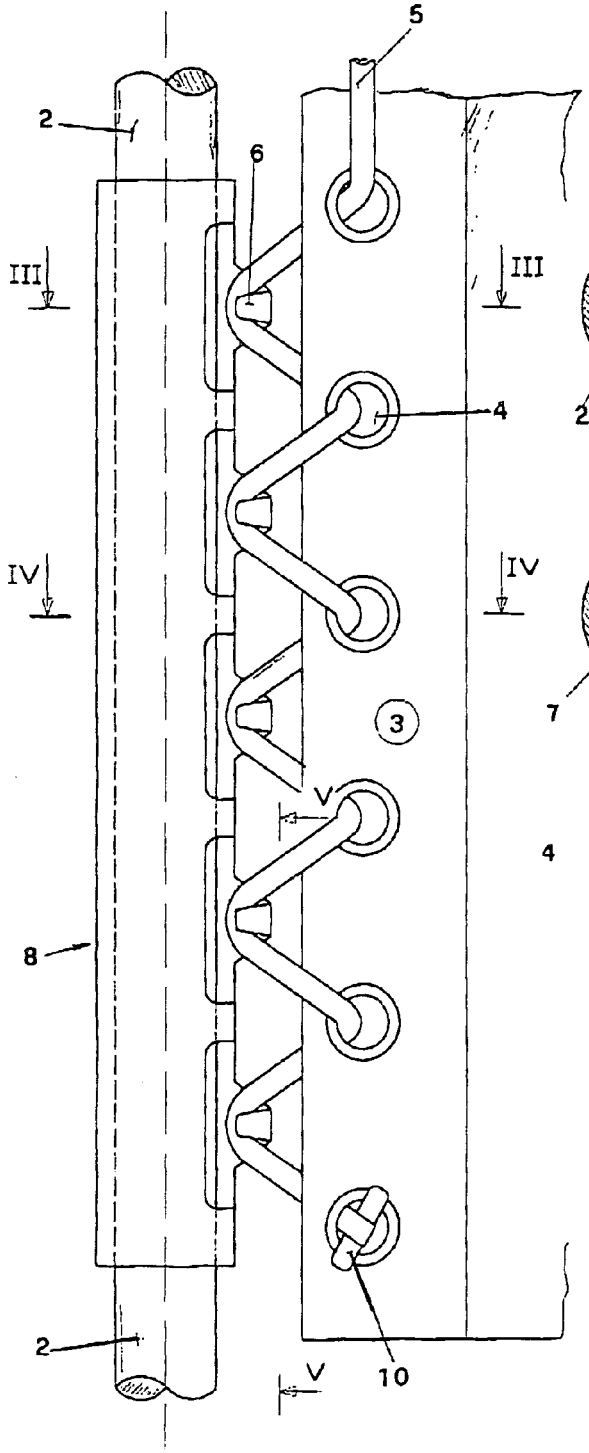
FIG. 2 (Table II) illustrates a detailed view of the fabric/frame hooking area.
Figure 3:
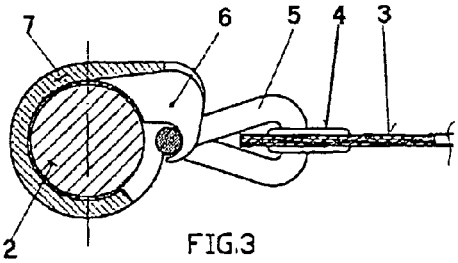
FIG. 3 illustrates a section view of the chair, according to the line III—III: of FIG. 2.
Figure 4:
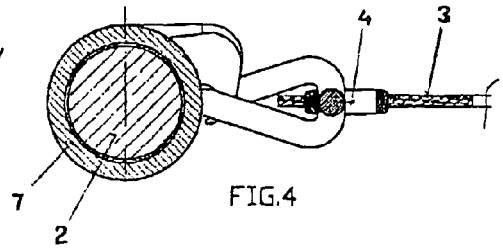
FIG. 4 illustrates a section view of the chair, according to the line. IV—IV of FIG. 2.
Figure 5:
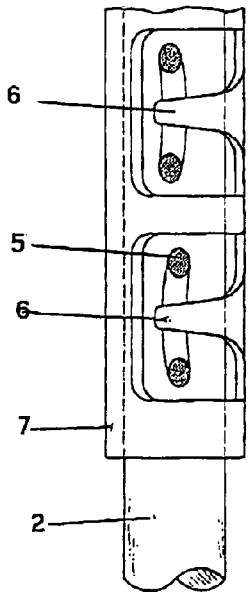
FIG. 5 illustrates a side view of the chair, according to the line V—V of FIG. 2.

FIG. 1 shows the chair according to the finding, generally indicated with reference number 1, including a frame 2, to which one single piece of fabric 3 is fixed, acting as a back 3' and seat 3" and, optionally, with an extension 3'", all with the methods already known.

The finding is essentially related to the mutual methods of fixing between said frame 2 and said fabric 3.

Observing the drawings from 2 onwards, in correspondence with the ends of the fabric a plurality of eyelets 4 can be identified through which a cord 5 is inserted; on the contrary, the frame has a plurality of hooks 6, upwards to the fabric and placed between every two consecutive eyelets, said hooks aimed at fixing the above-mentioned cord 5, therefore defining fixing of the fabric to the frame.

The hooks 6 are joined with a tube 7 which is inserted into the frame in such a way as to position its hooks in compliance with the eyelets 4 of the fabric and to allow the user to hook the cord 5 to the same.

The entire element 8, made up of a tube and hooks, is preferably realized through moulding of plastic material and its locking onto the portion of the frame to which it is fixed is guaranteed by the friction generated by the two members by means of the fabric 3. Such fabric 3 when it is hooked on both sides using the cords 5 to the hooks 6, applies enough pulling force inwards to fix the above-mentioned members in a secure manner without the need to use rivets or other fixed connections.

Obviously there are devices suitable to connect the cord to the first eyelets in the row; as a pure example the presence of a rod 10 can be provided, in the methods already known, joined to the ends of the cord, longer than the diameter of the eyelets and therefore designed not to protrude from the last eyelet in which it has been inserted, unless a specific manoeuvre is carried out.

The above indications illustrate how the device according to the finding allows for a simple and rapid removal and replacement of the fabric from a chair frame without using any tool.

What is claimed is:

1. A folding deckchair, of the kind that has a frame (2) having side portions to which a fabric (3) having side ends is fixed wherein fixing between the side ends of the fabric and the side portions of the frame is achieved using an elastic cord (5) inserted through a plurality of eyelets (4), located on the edges of the fabric and also hooked to a plurality of hooks (6), located between two subsequent eyelets and protruding from the frame, said chair being characterized in that the hooks (6) are fitted to a tube (7) which is fixed onto the frame in such a way as to position each hook between every two subsequent eyelets.

2. A folding deckchair, according to claim 1, characterized in that the tube (7) and the hooks (6) are formed on an element (8) which is made through moulding of plastic material.

3. A folding deckchair, according to claim 2, characterized by the fact that element (8) is held onto the portion of the frame by the friction that occurs between the two members by virtue of the fabric (3) which, when it is fixed on both sides by the cords (5) to the hooks (6), it applies enough pulling force to fix element (8) to the frame in a secure manner.

* * * * *